US005538053A

United States Patent [19]

Derby

[11] Patent Number: 5,538,053

[45] Date of Patent: Jul. 23, 1996

[54] VACUUM DENSIFIER WITH AUGER

[75] Inventor: Norwin C. Derby, Dallas, Tex.

[73] Assignee: Better Agricultural Goals Corporation, Dallas, Tex.

[21] Appl. No.: 483,736

[22] Filed: Jun. 7, 1995

Related U.S. Application Data

[63] Continuation-in-part of Ser. No. 302,377, Sep. 8, 1994, which is a continuation of Ser. No. 105,341, Aug. 9, 1993, abandoned, which is a continuation of Ser. No. 875,636, Apr. 28, 1992, Pat. No. 5,234,037, which is a continuation of Ser. No. 558,678, Jul. 27, 1990, abandoned, which is a continuation-in-part of Ser. No. 407,901, Sep. 15, 1989, abandoned.

[51] Int. Cl.[6] ..... B65B 1/26

[52] U.S. Cl. ..... 141/71; 141/65; 141/256; 222/152; 222/413; 222/442; 222/447; 222/450

[58] Field of Search ..... 222/412, 413, 222/152, 425, 442, 445, 447, 450; 141/10, 12, 59, 65, 67, 68, 71, 256, 313

[56] References Cited

U.S. PATENT DOCUMENTS

| | | | |
|---|---|---|---|
| 2,138,356 | 11/1938 | Ryan et al. . | |
| 2,142,990 | 1/1939 | Belcher . | |
| 2,421,418 | 6/1947 | Grossman | 222/413 X |
| 2,489,925 | 11/1949 | Omwake . | |
| 2,688,416 | 9/1954 | Skretting . | |
| 2,720,375 | 10/1955 | Carter . | |
| 2,760,702 | 8/1956 | Pechy . | |
| 2,780,247 | 2/1957 | Claassen, Jr. . | |
| 2,783,786 | 3/1957 | Carter . | |
| 2,815,621 | 12/1957 | Carter . | |
| 2,964,070 | 12/1960 | Linhardt . | |
| 3,063,477 | 11/1962 | Vogt . | |
| 3,101,853 | 8/1963 | Long et al. . | |
| 3,150,798 | 9/1964 | Sutton | 222/413 X |
| 3,232,494 | 2/1966 | Poarch . | |
| 3,258,041 | 6/1966 | Lau . | |
| 3,260,285 | 7/1966 | Vogt . | |
| 3,542,091 | 11/1970 | Carter . | |
| 3,586,066 | 6/1971 | Brown . | |
| 3,589,411 | 6/1971 | Vogt . | |
| 3,605,826 | 9/1971 | Carter . | |
| 3,656,518 | 4/1972 | Aronson . | |
| 3,664,385 | 5/1972 | Carter | 141/12 |
| 3,785,410 | 1/1974 | Carter . | |
| 3,788,368 | 1/1974 | Geng et al. | 141/67 |
| 3,847,191 | 11/1974 | Aronson . | |
| 4,060,183 | 11/1977 | Puurunen . | |
| 4,182,386 | 1/1980 | Alack . | |
| 4,185,669 | 1/1980 | Jevakohoff . | |
| 4,219,054 | 8/1980 | Carter et al. . | |
| 4,397,657 | 8/1993 | Selep et al. . | |
| 4,457,125 | 7/1984 | Fishburne . | |
| 4,526,214 | 7/1985 | McGregor . | |
| 4,545,410 | 10/1985 | Paul et al. | 141/67 |
| 4,573,504 | 3/1986 | Rosenstrom . | |
| 4,603,795 | 8/1986 | Bonerb et al. | 222/413 X |
| 4,614,213 | 9/1986 | Englin . | |
| 4,648,432 | 3/1987 | Mechalas . | |
| 4,854,353 | 8/1989 | Russell . | |
| 4,912,681 | 3/1990 | Halsey et al. . | |
| 5,109,893 | 5/1992 | Derby | 141/67 |
| 5,234,037 | 8/1993 | Derby | 141/67 |

FOREIGN PATENT DOCUMENTS

| | | |
|---|---|---|
| 1265286 | 5/1961 | France . |

*Primary Examiner*—J. Casimer Jacyna
*Attorney, Agent, or Firm*—Michael A. O'Neil; Russell N. Rippamonti

[57] ABSTRACT

A vacuum fill system for deaerating flowable materials for storage in a receiving container comprising a hollow tubular container having a generally horizontal axis for receiving and holding flowable material. A vacuum pump or venturi and suitable valving are used to first create a vacuum within the chamber and then to return the chamber to atmospheric pressure instantaneously, thereby compacting the flowable material. An auger extends from the inlet end of the tubular container to the outlet end of the tubular container for moving flowable material into and compacted material out of the tubular container into a receiving container.

14 Claims, 2 Drawing Sheets

VACUUM DENSIFIER WITH AUGER

RELATED APPLICATION

This application is a continuation-in-part under 37 C.F.R. §1.53 of prior application Ser. No. 08/302,377 entitled VACUUM FILL SYSTEM, filed Sep. 8, 1994, currently pending, which is a file wrapper continuation of application Ser. No. 08/105,341, filed Aug. 9, 1993, now abandoned, which is a continuation of application Ser. No. 07/875,636, filed Apr. 28, 1992, now issued as U.S. Pat. No. 5,234,037, which is a continuation of application Ser. No. 07/558,678, filed Jul. 27, 1990, now abandoned, which is a continuation-in-part of application Ser. No. 07/407,901 filed Sep. 15, 1989, now abandoned.

TECHNICAL FIELD OF THE INVENTION

This invention relates to a vacuum fill system for deaerating flowable materials for storage in a container, and in particular, to a vacuum densifier with auger for deaerating and compacting flowable materials prior to filling a container.

BACKGROUND OF THE INVENTION

Traditional filling processes and containers have long been encumbered by a simple phenomenon that has exasperated consumers for decades—settling. Settling, as any purchaser of a bag of potato chaps knows, means the bag is never completely filled when opened. This occurs due to the settling of the product inside during its filling and shipment. This simple settling phenomenon causes tremendous economic waste each year due to the wasting of storage space and container materials. This has been particularly true in the storage, transportation, and dispensation of flowable materials in semi-bulk quantities such as grains, chemicals and other bulky substances stored in flexible, bulk containers, such as those disclosed in U.S. Pat. Nos. 4,143,796 and 4,194,652.

It has long been known that the settling process is caused by the natural aeration of flowable materials as the materials are placed inside a container. As the container is shipped to its final destination, the air is displaced from the aerated material mixture causing the product to compact and reduce in volume. Thus, when the container is opened, the flowable material has settled to the bottom of the container, i.e. the bag of potato chips is only half full.

Any process or system, such as the present invention, for deaerating the flowable material prior to filling a container for shipment that allows more of the container to be filled with product and reduces the excess air results in an enormous cost savings. Indeed, the shipment of smaller sized containers using vacuum sealed packages such as, e.g., vacuum sealed coffee containers, has alleviated many of the above problems of cost and time.

The present invention substantially eliminates settling and the inherent problems associated therewith by deaerating flowable material prior to filling a container for shipment. Use of the present invention thus allows more product to be transported in the same size container than is possible using prior techniques. Thus, by utilizing all of the container space, the present invention allows for the far more efficient total use of all of the container materials and space.

SUMMARY OF THE INVENTION

The present invention comprises a vacuum fill system for deaerating flowable materials for storage in a container, and in particular, to a vacuum densifier with auger for deaerating and compacting flowable materials prior to filling a container.

The vacuum densifier with auger of the present invention generally comprises a tubular container for holding flowable material oriented with its axis in a generally horizontal plane; a device for controlling the flow of the flowable material into the tubular container; apparatus for creating a vacuum in the tubular container and returning the chamber to atmospheric pressure instantaneously thereby compacting the deaerated material; an auger located inside the tubular container for removing the compacted flowable material from the tubular container; and a device for controlling the flow of the compacted flowable material from the tubular container into a storage container for shipment.

In the preferred embodiment of the invention, the tubular container has a circular cross section. A first conventional full opening ball or gate valve is located at the inlet end of the tubular container for controlling the flow of flowable materials into the tubular container. A conventional vacuum pump or high vacuum venturi, capable of pulling a vacuum of eighteen (18) inches of mercury, is connected to the tubular container through a series of valves and vacuum lines.

An auger extends from the inlet end of the container to the outlet end of the tubular container. The auger includes a driver for rotating the auger a predetermined number of rotations sufficient to move the compacted material to the outlet end of the tubular container.

A second conventional full opening ball or gate valve is located at the outlet end of the tubular container for controlling the flow of compacted flowable material into the storage container.

In this operation of the vacuum densifier, flowable material is fed into the horizontal tubular container. A vacuum is created through the use of a plurality of valves spaced along the top of the tubular container and a conventional vacuum pump or high vacuum venturi. After sufficient deaeration of the flowable material is achieved, the vacuum is released and the interior of the container is returned to atmospheric pressure substantially instantaneously causing the material to compact in the bottom to the horizontal tubular container. The auger rotates through a predetermined number of rotations which move the compacted flowable material to the outlet of the tubular container and into a container for shipment.

In alternative embodiments, the tubular container may be an enclosed trough having a "U" shaped cross section.

By deaerating and compacting the flowable material before filling the container, through the use of the vacuum densifier and auger, the flowable material is presettled and will not settle during shipment. Thus, the present invention allows for more complete utilization of the flexible container, eliminating wasted space and allowing for the shipment of more material without any increase in the container volume.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE INVENTION

Figure 1:
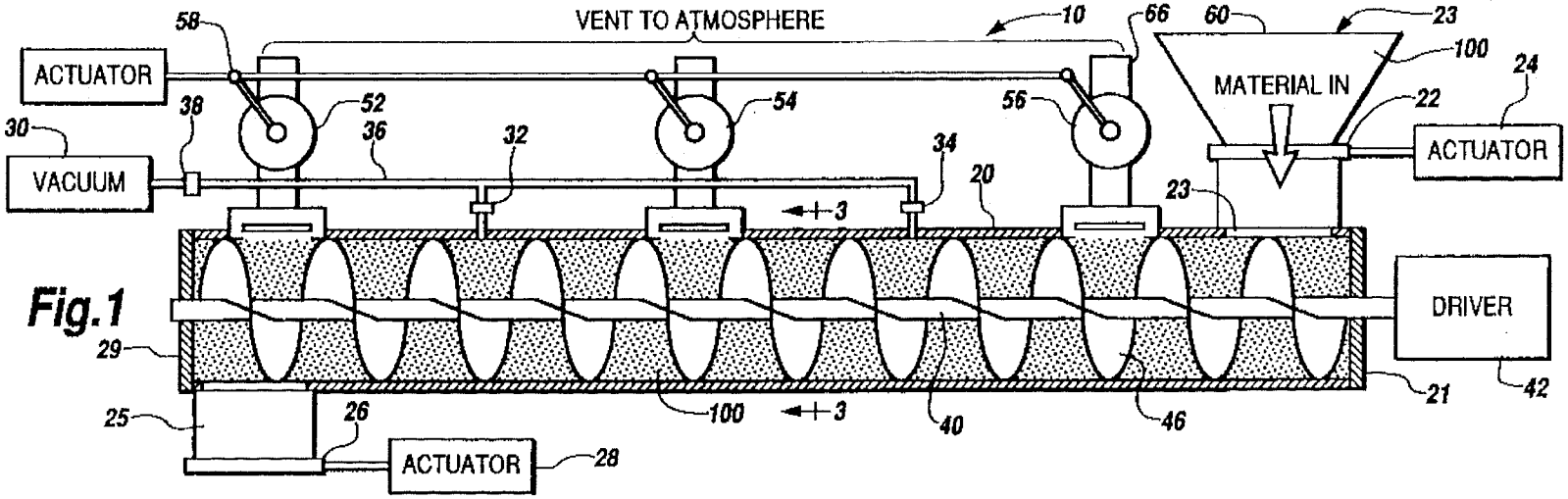
FIG. 1 is a sectional view of the vacuum densifier with auger for deaerating and compacting flowable materials prior to deaerating and compacting the flowable material.

Referring to FIG. 1, the present invention comprises a vacuum densifier with auger 10 for deaerating and compacting flowable materials. In the preferred embodiment of the invention, a tubular container 20 for receiving flowable material has a generally horizontal axis. An inlet 23 including a conventional full opening ball or gate valve 22 and valve actuator 24 is located at the inlet end of the tubular container 20 for controlling the flow of flowable materials into the tubular container. A conventional vacuum pump 30 or high vacuum venturi, capable of pulling a vacuum of eighteen (18) inches of mercury, for deaerating the flowable materials is connected to the tubular container through a series of valves 32 and 34 and vacuum lines 36. Also connected to the vacuum line 36 is a conventional pressure switch 38, which is utilized to control the closing of the valves 32 and 34.

An auger 40 extends from the inlet end 21 of the tubular container 20 to the outlet end 29 of the tubular container 20. The auger includes a driver 42 for rotating the auger a predetermined number of rotations equal to the number of flights 46 on the auger 40.

A plurality of quick opening butterfly or ball type valves 52, 54 and 56 and a valve actuator 58 are located on the top of the tubular container 20. The valves 52, 54 and 56 are vented to atmosphere.

An outlet 25 including a conventional full opening ball or gate valve 26 and valve actuator 28 is located at the outlet end 29 of tubular container 20 for controlling the flow of compacted flowable material out of tubular container 20 into the storage container.

Operation of the vacuum densifier is simple and easy. In FIG. 1 there is illustrated the filling and compaction of flowable material in the tubular chamber 20. Valves 22 and 26 are open. Flowable material 100 is contained within a conventional holding/storage device 60, such as a hopper, which is connected to inlet valve 22. Flowable material 100 is fed from hopper 60 through inlet valve 22 into tubular container 20 while auger 40 is rotated through a predetermined number of revolutions equal to the number of flights 46 on the auger 40. Alternatively, the flow of flowable material into the tubular container 20 may be controlled by weight. When the predetermined number of rotations or weight is reached, inlet valve 22 and outlet valve 26 automatically close preventing the flow of additional flowable material 100 into or out of the tubular container 20.

After completion of the feeding and auger rotation steps, the tubular container is generally filled with uncompacted, aerated flowable material 100 as depicted by the stippling in FIG. 1. Valves 52, 54 and 56 which vent to the atmosphere are closed. Valves 32 and 34 are opened and vacuum pump 30 draws a vacuum in tubular container 20 to a predetermined level, for example, 18 inches of mercury.

Once the vacuum reaches the necessary level to achieve the desired deaeration of the flowable material 100, valves 52, 54 and 56 are opened immediately. In the preferred embodiment the valves 52, 54 and 56 are quick opening ball or butterfly valves. Valves 52, 54 and 56 must be opened suddenly and fully in order to get a high impact on the material 100 from the entering air. The impact of the entering air compresses and compacts the flowable material 100. As the pressure in the tubular container 20 increases, the volume of flowable material 100 decreases in such a way that increasing pressure waves propagate at faster speeds, thereby causing a shock wave to form from the coalescence of many weaker pressure waves. When the wave reaches the bottom of the tubular container 20 a reflected wave is generated which propagates up through the flowable material 100 causing additional compaction. The action of these waves is non-isotropic and irreversible to such an extent that except for small elastic recovery, most of the density increase caused by the wave motion is retained.

Figure 2:
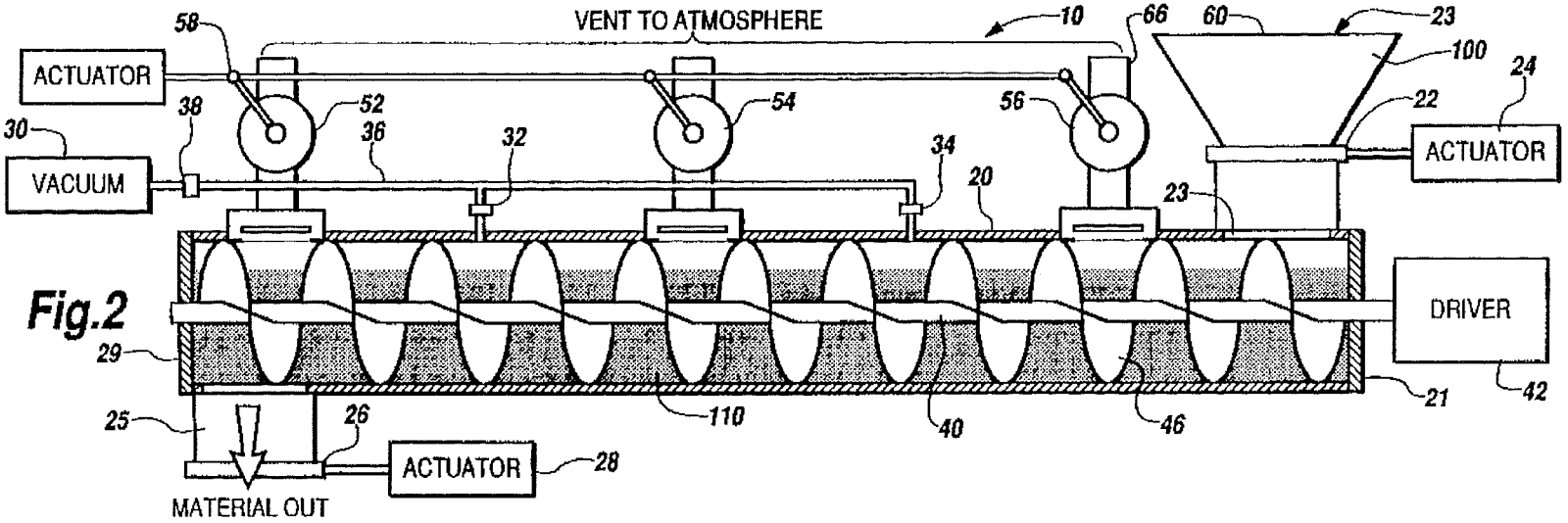
FIG. 2 is a sectional of view of the vacuum densifier with auger for deaerating and compacting flowable materials after deaerating and compacting the flowable material prior to filling shipping containers.

Turning to FIG. 2, therein is illustrated by the stippling, flowable material 110 has been deaerated and compacted and that the volume of material 100 (in FIG. 1) is now significantly less than when first introduced into the tubular container 20.

Subsequently, valve 26 is opened and auger 40 is rotated through a predetermined number of rotations equal to the number of flights 46 on the auger. The compacted, deaerated flowable material 110 is fed out through outlet valve 26 into the desired container.

Concurrently with discharge of the compacted deaerated material 110 valve 22 is opened and uncompacted material 100 is fed into the tubular chamber 20 beginning a new cycle.

Figure 3:
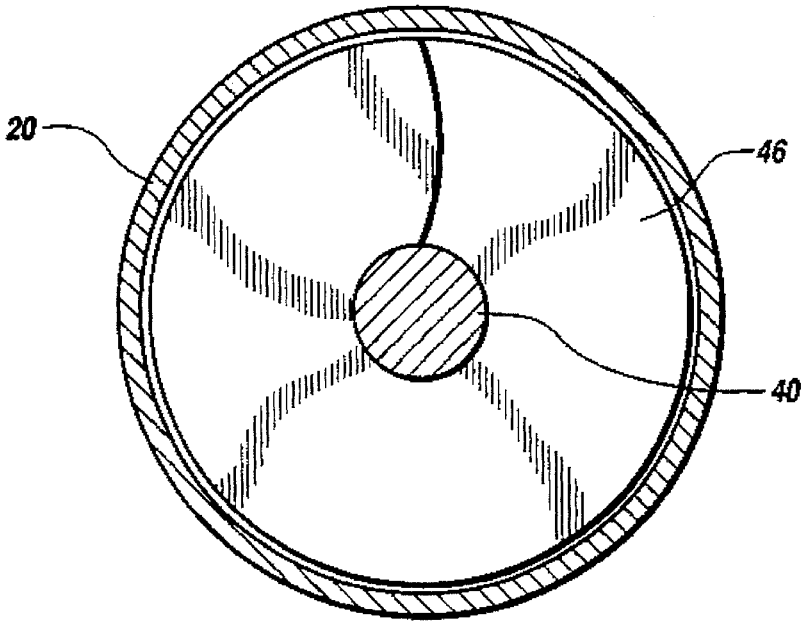
FIG. 3 is a cross sectional view of the tubular container with a circular cross section.
Figure 4:
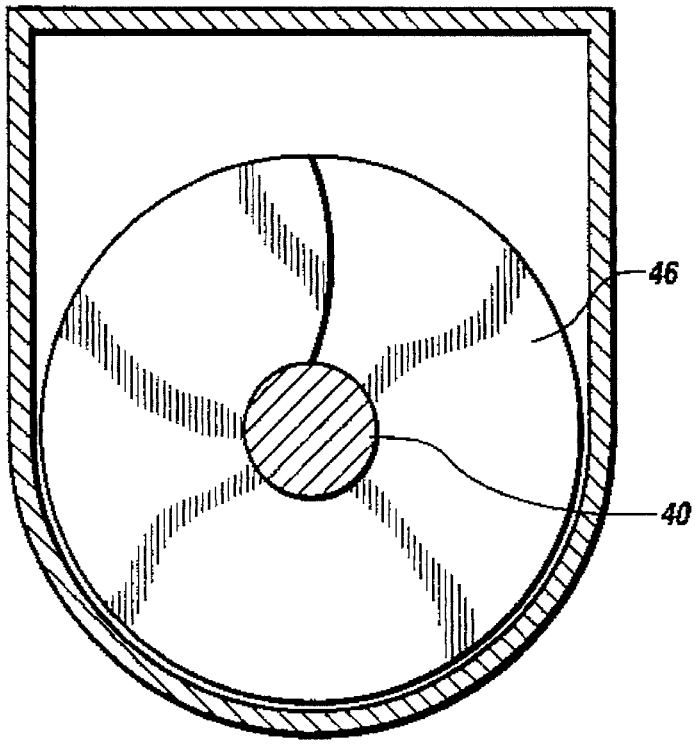
FIG. 4 is a cross sectional view of the tubular container with a "U" shaped cross section.

Turning to FIG. 3, therein is illustrated the preferred embodiment for the tubular container having a circular cross section. It is understood that other cross sectional configurations are feasible. In an alternative embodiment illustrated in FIG. 4, the tubular container is illustrated having a "U" shaped cross section.

Although not shown, it should be understood that the operation of the vacuum densifier with auger system may be performed either manually or automatically through the use of conventional electronic circuitry.

Although a preferred embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

We claim:

1. A vacuum fill system for deaerating flowable materials for storage in a receiving container, said vacuum fill system comprising:

a hollow tubular container for receiving and holding flowable materials, the hollow container having:
- an inlet end and an outlet end,
- a generally horizontal axis,
- a top and a bottom,
- a predetermined cross-sectional area,
- an air impervious sidewall extending continuously from the inlet end of the hollow container to the outlet end of the hollow container and comprising the sole connection therebetween, valve means for controlling the movement of the flowable material into the inlet end of the hollow container;

an auger extending from the inlet end of the hollow container to the outlet end of the hollow container for moving flowable material into and compacted material out of the hollow container;

means for creating a vacuum in the hollow container;

means for returning the pressure in the hollow container to atmospheric pressure substantially instantaneously for compacting the deaerated material, said means located in proximity to the top of the hollow container; and valve means for controlling the movement of the deaerated, compacted material from the outlet end of the hollow container into the receiving container.

2. A vacuum fill system for deaerating flowable materials in accordance with claim 1 wherein the valve means for controlling the flow of the flowable material into the hollow container further comprises a full opening valve and actuator attached to the hollow container at the inlet end.

3. A vacuum fill system for deaerating flowable material in accordance with claim 1 wherein the means for creating a vacuum in the hollow container comprises at least one valve and vacuum pump connected by a vacuum line to the hollow container.

4. A vacuum fill system for deaerating flowable material in accordance with claim 1 wherein the means for creating a vacuum in the hollow container comprises at least one valve and a high vacuum venturi connected by a vacuum line to the hollow container.

5. A vacuum fill system for deaerating flowable materials in accordance with claim 1 wherein the means for returning the pressure in the hollow container to atmospheric substantially instantaneously further comprises a vacuum line and at least one valve capable of opening to the atmosphere.

6. A vacuum fill system for deaerating flowable material in accordance with claim 1 wherein the valve means for controlling the movement of the deaerated, compacted material from the outlet end of the hollow container comprises a full opening valve and actuator attached to the hollow container at inlet end.

7. A vacuum fill system for deaerating flowable material in accordance with claim 1 wherein the hollow container has a generally circular cross sectional configuration.

8. A vacuum fill system for deaerating flowable material in accordance with claim 1 wherein the hollow container has a generally "U" shaped cross sectional configuration.

9. A vacuum fill system for deaerating flowable materials for storage in a receiving container, said vacuum fill system comprising:

a hollow tubular container for receiving and holding flowable materials, the hollow container having:
an inlet end and an outlet end,
a generally horizontal axis,
a top and a bottom,
a predetermined cross-sectional area,
an air impervious sidewall extending continuously from the inlet end on the hollow container to the outlet end of the hollow container and comprising the sole connection therebetween, a full opening valve and actuator attached to the hollow container at the inlet end;

an auger extending from the inlet end of the hollow container to the outlet end of the hollow container for moving flowable material into and compacted material out of the hollow container;

at least one valve and vacuum pump connected by a vacuum line to the hollow container;

a vacuum line and at least one valve connected to the hollow container capable of opening to the atmosphere for returning the pressure in the hollow container to atmospheric pressure substantially instantaneously for compacting the deaerated material; and a full opening valve and actuator for controlling the movement of the deaerated, compacted material from the outlet end of the hollow container into the receiving container.

10. The vacuum fill system of claim 9 wherein the hollow container has a generally circular shaped cross sectional configuration.

11. The vacuum fill system of claim 9 wherein the hollow tubular container has a generally "U" shaped cross sectional configuration.

12. A vacuum fill system for deaerating flowable materials for storage in a receiving container, said vacuum fill system comprising:

a hollow tubular container for receiving and holding the flowable materials, the hollow container having:
an inlet end and an outlet end,
a generally horizontal axis,
a top and a bottom,
a predetermined cross-sectional area,
an air impervious sidewall extending continuously from the inlet end on the hollow container to the outlet end of the hollow container and comprising the sole connection therebetween, an auger extending from the inlet end of the hollow container to the outlet end of the hollow container for moving flowable material into and compacted material out of the hollow container;

a full opening valve and actuator attached to the hollow container at the inlet end;

at least one valve and a high vacuum venturi connected by a vacuum line to the hollow container;

a vacuum line and at least one valve capable of opening to the atmosphere connected to the hollow container in proximity to the top of the hollow container for returning the pressure in the hollow container to atmospheric pressure substantially instantaneously for compacting the deaerated material; and a full opening valve and actuator for controlling the movement of the deaerated, compacted material from the outlet end of the hollow container into the receiving container.

13. The vacuum fill system of claim 12 wherein the hollow tubular container has a generally circular cross sectional configuration.

14. The vacuum fill system of claim 12 wherein the hollow tubular container has a "U" shaped cross sectional configuration.

* * * * *